US011230464B2

(12) United States Patent
Jacob et al.

(10) Patent No.: US 11,230,464 B2
(45) Date of Patent: Jan. 25, 2022

(54) COSMETIC DOSING SYSTEM

(71) Applicant: ELC MANAGEMENT LLC, Melville, NY (US)

(72) Inventors: Christophe Jacob, Pradons (FR); Herve F. Bouix, New York, NY (US)

(73) Assignee: ELC Management LLC, Melville, NY (US)

( * ) Notice: Subject to any disclaimer, the term of this patent is extended or adjusted under 35 U.S.C. 154(b) by 0 days.

(21) Appl. No.: 16/656,052

(22) Filed: Oct. 17, 2019

(65) Prior Publication Data

US 2021/0114856 A1 Apr. 22, 2021

(51) Int. Cl.

| | |
|---|---|
| ***B67C 3/24*** | (2006.01) |
| ***A45D 34/00*** | (2006.01) |
| ***B67C 3/20*** | (2006.01) |

(52) U.S. Cl.

CPC ..... *B67C 3/20* (2013.01); *A45D 34/00* (2013.01); *B67C 3/24* (2013.01); *A45D 2034/002* (2013.01)

(58) Field of Classification Search

CPC .... A45D 34/00; A45D 2034/002; B67C 3/20; B67C 3/24

See application file for complete search history.

(56) References Cited

U.S. PATENT DOCUMENTS

| | | | | |
|---|---|---|---|---|
| 2009/0045089 | A1* | 2/2009 | Sheppard | A45D 40/262 206/362.3 |
| 2010/0242981 | A1 | 9/2010 | Bouix et al. | |
| 2020/0323751 | A1* | 10/2020 | Kim | A45D 34/04 |
| 2020/0383457 | A1* | 12/2020 | Park | A46B 5/021 |

FOREIGN PATENT DOCUMENTS

| | | |
|---|---|---|
| EP | 0078356 | 11/1986 |

OTHER PUBLICATIONS

PCT International Search Report; International Application No. PCT/US2020/056192; Completion Date: Feb. 2, 2021; dated Feb. 3, 2021.

PCT Written Opinion of the International Searching Authority; International Application No. PCT/US2020/056192; Completion Date: Feb. 2, 2021; dated Feb. 3, 2021.

Taiwanese Search Report from counterpart TW application 109136165.

* cited by examiner

*Primary Examiner* — Jason K Niesz

(74) *Attorney, Agent, or Firm* — Phoenix S. Pak; Tiffany A. Johnson

(57) ABSTRACT

A cosmetic dosing system or kit may provide a display arranged to house one or more dosing containers and a handle. The one or more dosing containers may house cosmetic product and provide applicators that may be interchangeable with the handle. A magnetic closure may be utilized to attach the one or more dosing containers to the handle. The cosmetic dosing system or kit may provide a luxurious display that may reduce contamination of cosmetic product and prevent cosmetic product from drying.

8 Claims, 5 Drawing Sheets

COSMETIC DOSING SYSTEM

FIELD OF THE INVENTION

The present invention generally relates to cosmetic packaging, and more particularly, to a cosmetic dosing system including cosmetic dosing containers.

BACKGROUND OF THE INVENTION

Cosmetic product is typically housed in containers that can lead to drying of the cosmetic product and contamination over time. Other cosmetic containers and handles for use with the containers can provide a rigid assembly and fail to offer additional cosmetic containers for use with the same handle. Further, cosmetic systems can provide an unattractive appearance that may not offer users a luxurious display for supporting cosmetic containers and handles.

SUMMARY OF THE INVENTION

Embodiments of the present disclosure generally provide a cosmetic dosing system that may provide one or more dosing containers. The one or more dosing containers may include one or more magnets, and the one or more dosing containers may be arranged on a display. The cosmetic dosing system may provide a handle that may have an opposing magnet attracted to the one or more magnets. The handle may be capable of attaching to and removable from the display.

Other embodiments of the present disclosure may provide a cosmetic dosing kit that may provide one or more dosing containers including one or more magnets and one or more applicators housed inside the one or more dosing containers. The cosmetic dosing kit may further provide a handle that may have an opposing magnet attracted to the one or more magnets, and a display that may be configured to house the one or more dosing containers and the handle.

The foregoing summary is only intended to provide a brief introduction to selected features that are described in greater detail below in the detailed description. Other technical features may be readily apparent to one skilled in the art from the following drawings, descriptions and claims. As such, this summary is not intended to identify, represent, or highlight features believed to be key or essential to the claimed subject matter. Furthermore, this summary is not intended to be used as an aid in determining the scope of the claimed subject matter.

BRIEF DESCRIPTION OF THE DRAWINGS

Various exemplary embodiments are illustrated by way of example, and not by way of limitation, in the figures of the accompanying drawings in which like reference numerals refer to similar element and in which.

DETAILED DESCRIPTION OF THE INVENTION

The present disclosure generally provides one or more dosing containers arranged on a display. An applicator handle may be arranged on the display, and a magnetic closure may secure each of the one or more dosing containers to the applicator handle. Each of the one or more dosing containers may interchangeably attach to the applicator handle. In the following description, for purposes of explanation, numerous specific details are set forth in order to provide a thorough understanding of the disclosed embodiments. It will become apparent, however, to one skilled in the art that various embodiments may be practiced without these specific details or with an equivalent arrangement.

Figure 1:
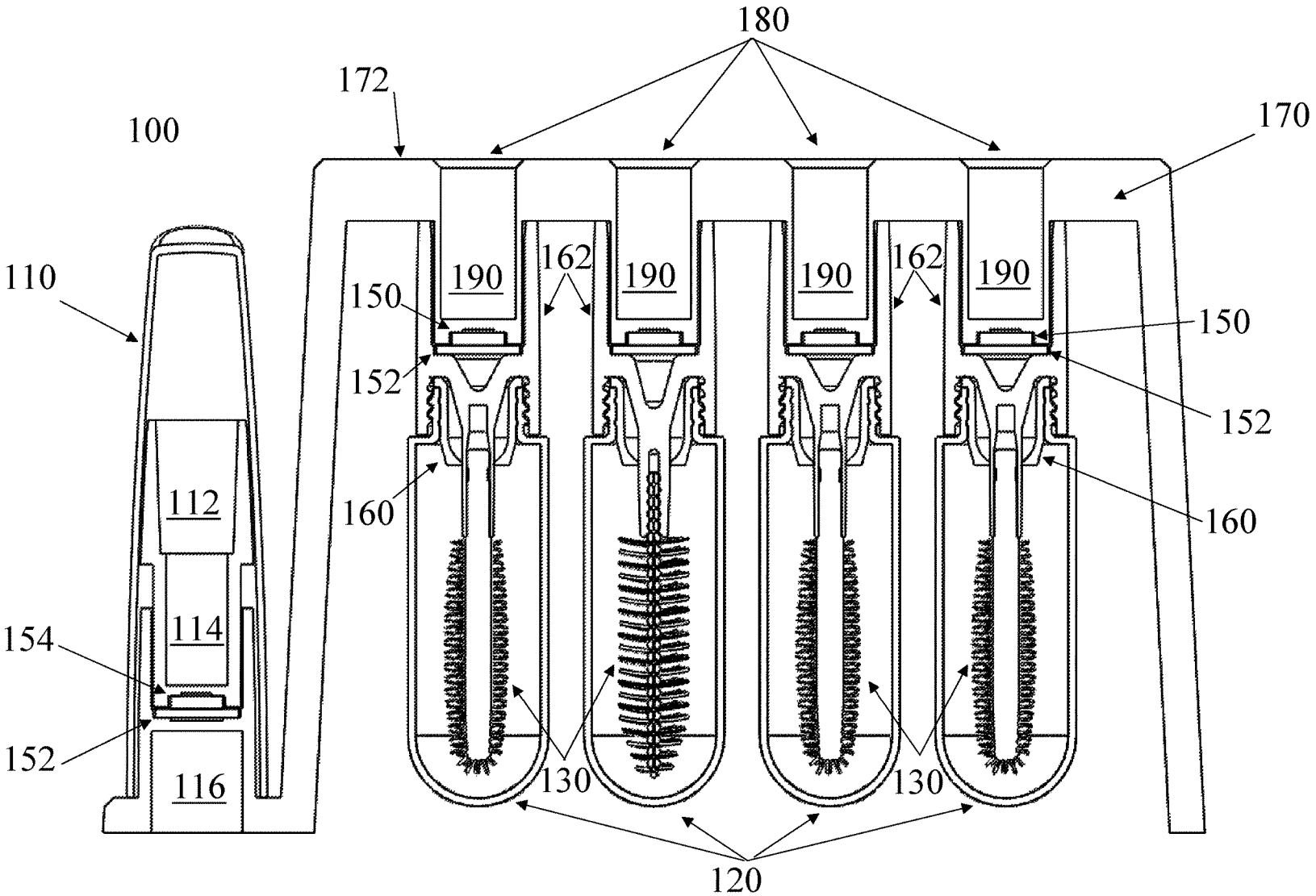
FIG. 1 depicts a front view of a cosmetic dosing system according to an embodiment of the present disclosure.
Figure 2:
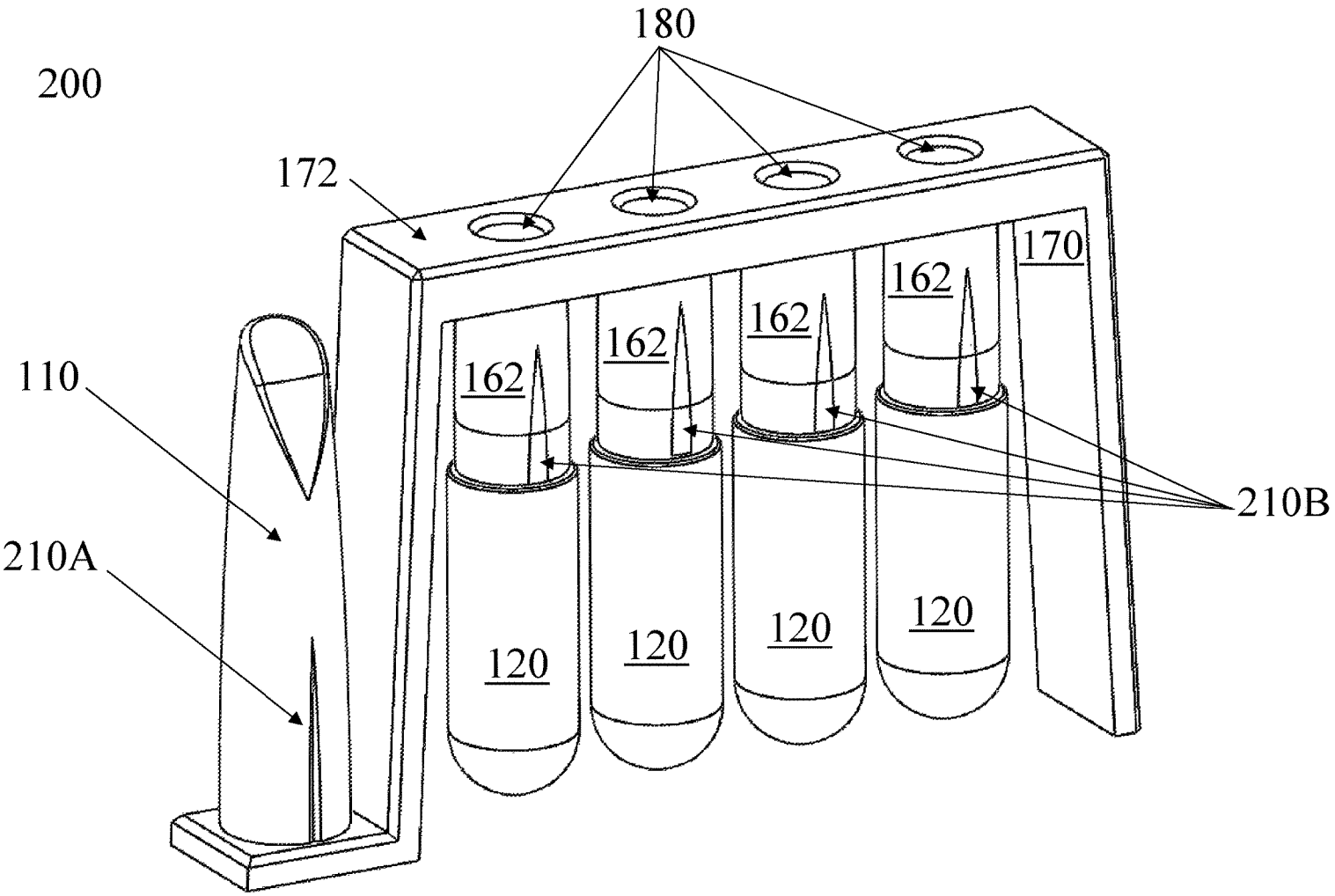
FIG. 2 depicts a perspective view of a cosmetic dosing system according to an embodiment of the present disclosure.

FIGS. 1-2 depict cosmetic dosing system 100, 200 according to an embodiment of the present disclosure. Cosmetic dosing system 100, 200 may provide handle 110, one or more dosing containers 120, one or more applicators 130 (FIG. 1), and display 170. One or more dosing containers 120 may each contain a dose of a cosmetic preparation or product. It should be appreciated that the cosmetic preparation or product may be mascara, eyeliner, eye shadow concealer, lip gloss, skin cream, or another cosmetic preparation or product. One or more dosing containers 120 may each connect with rod 162 that may provide a closure for one or more dosing containers 120. Rod 162 may protrude from one or more dosing containers 120 and attach to one or more attachment mechanisms 180. Attachment mechanisms 180 may be arranged underneath top 172 of display 170 to provide a mechanism to secure rod 162 to display 170. Rod 162 may provide aperture 190 that may provide a top end for connecting with attachment mechanism 180. A combination of rod 162 and one or more dosing containers 120 may interchangeably attach to the attachment mechanisms 180 of display 170. For example, a user may attach any of rod 162 and one or more dosing containers 120 to any attachment mechanism 180 provided along display 170. It should be appreciated that interchangeably attaching one or more dosing containers 120 to display 170 may provide a user access to a variety of cosmetic preparations or products along a single display without departing from the present disclosure. Rod 162 may provide a closure for one or more dosing containers 120 against attachment mechanism 180 on a first end and a connection with one or more dosing containers 120 on a second end. It should be appreciated that display 170 may be made of poly(methyl methacrylate). It should also be appreciated that display 170 may be made of materials resistant to damage, wear and tear, and corrosion without departing from the present disclosure.

Wiper 160 may be arranged inside rod 162. A snap-fit connection may secure wiper 160 inside rod 162. Wiper 160 may be provided to clean or wipe one or more applicators 130. It should be appreciated that wiper 160 may be made using injection molding or another manufacturing process. It should also be appreciated that wiper 160 may be made of low-density polyethylene (LDPE), a Hytrel® thermoplastic elastomer, rubber, nitrile, and/or other materials.

One or more metal plates 152 (FIGS. 1, 3, and 5) may be affixed inside one or more dosing containers 120. One or more magnets 150 may be affixed to the attachment mechanisms 180. A combination of one or more magnets 150 and one or more metal plates 152 may provide a magnetic attachment for one or more dosing containers 120 to the display 170. To prepare for use, any one of the one or more dosing containers 120 may be secured against handle 110 to create a clicking sound or noise to alert a user that the connection between one or more dosing containers 120 and handle 110 is secure. One or more magnets 150 may be neodymium magnets (NdFeB). It should be appreciated that one or more magnets 150 may have a diameter of approximately 5 millimeters (mm) and a height of approximately 1.5 mm. It should also be appreciated that one or more magnets may have an N45 magnetization grade. It should further be appreciated that one or more magnets 150 may have a nickel-plated coating (Ni—Cu—Ni), an adherence force of approximately ±455 g, and a maximum temperature of approximately 85 degrees Celsius. Magnetization of one or more magnets 150 may be axial. It should be appreciated that other types of magnets may be used without departing from the present disclosure.

Figure 3:
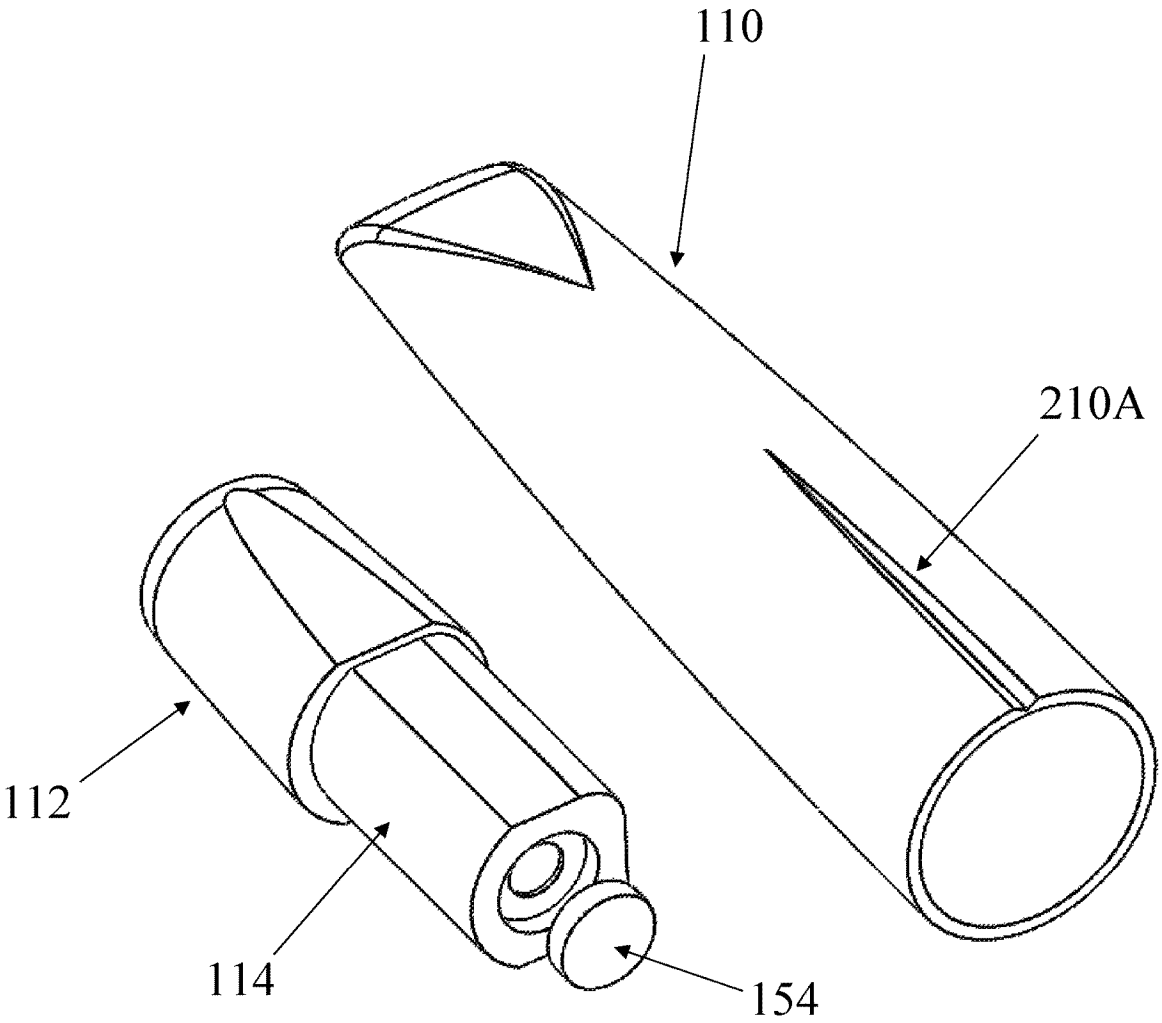
FIG. 3 depicts a perspective view of a handle and dosing container according to an embodiment of the present disclosure.
Figure 4:
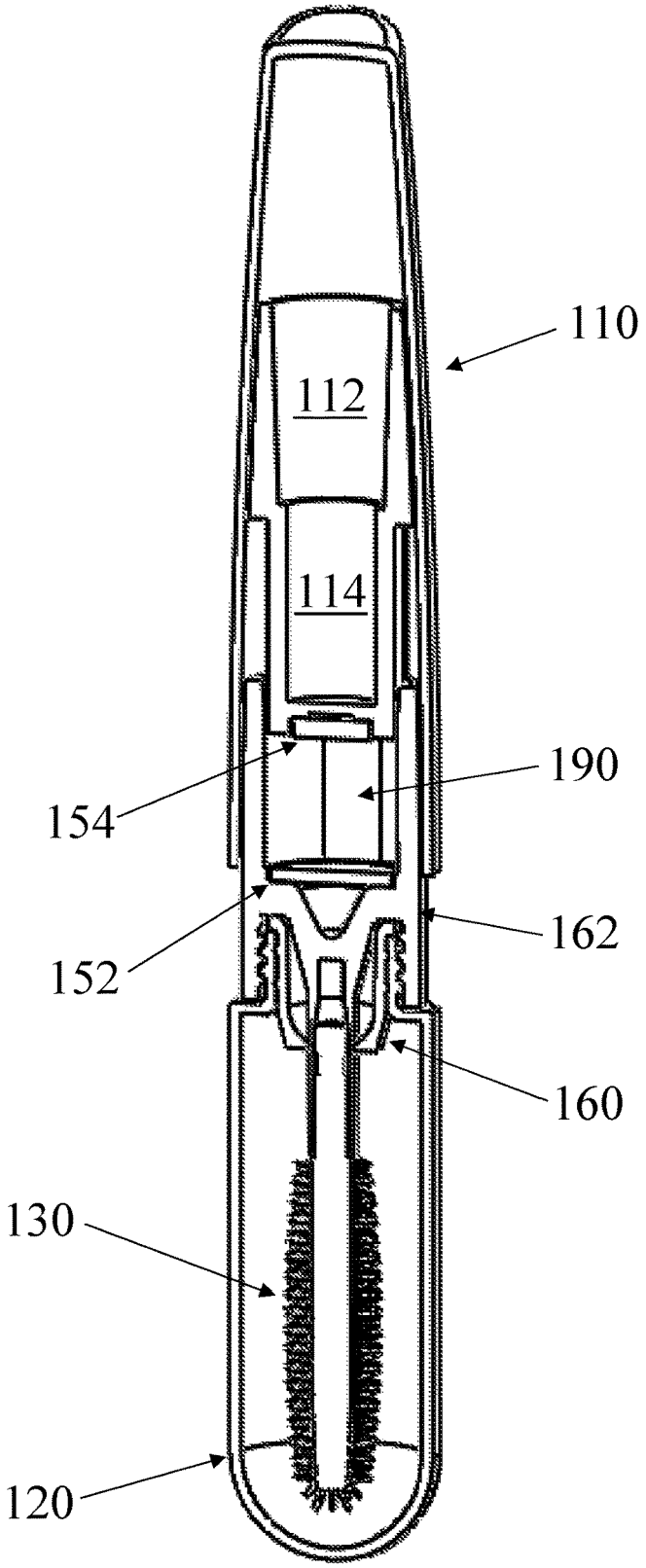
FIG. 4 depicts a side view of an assembled handle, dosing container, and applicator according to an embodiment of the present disclosure.
Figure 5:
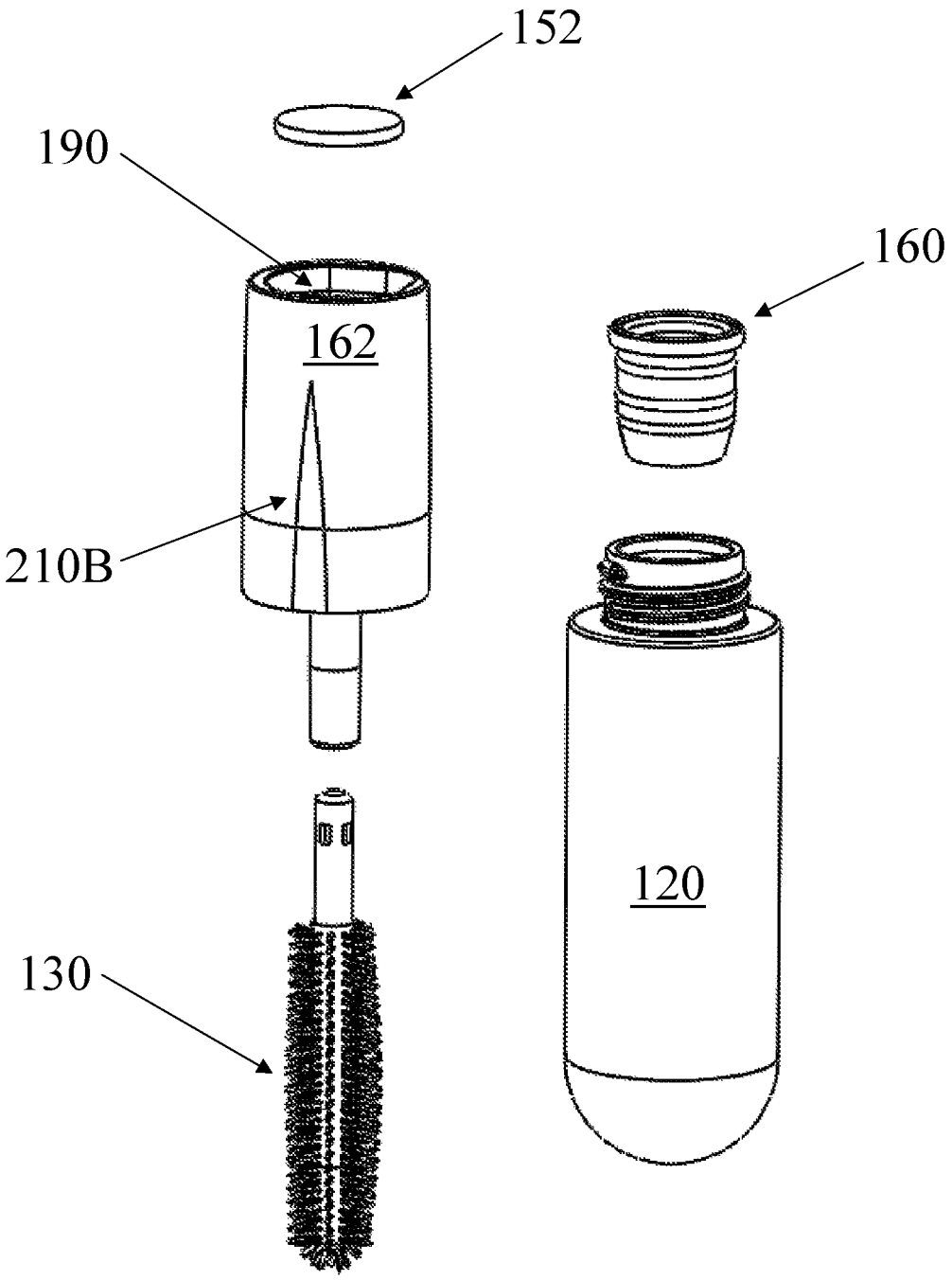
FIG. 5 depicts a perspective view of a dosing container and an applicator according to an embodiment of the present disclosure.

Handle 110 may provide inner handle 112 (FIGS. 1, 3, and 4) that may be secured in an interior of handle 110 by utilizing an adhesive and/or a snap-fit connection. Inner handle 112 may provide extension 114 (FIGS. 1, 3, and 4) that may be attached to opposing magnet 154 (FIGS. 1, 3 and 4). Display 170 may have a handle storage mount 116 (FIG. 1) with a second metal plate or disc 152 (FIG. 1) fixably attached where the handle assembly can be stored. It should be appreciated that extension 114 may be shaped to fit on or around the storage mount 116 and opposing magnet 154 may be attracted to and engage metal plate or disc 152 to secure handle 110 to the display 170. Closure or rod 162 may be inserted inside of handle 110 and may align utilizing indicators 210A, 210B (FIGS. 1, 3, and 5). Attachment mechanism 180 may secure closure or rod 162 against display 170. Attachment mechanism 180 may provide a shape similar to a spherical or cylindrical cap where one end may be flush with a top of display 170 and an opposite end may be flush with the end of closure or rod 162 proximate display 170. It should be appreciated that indicators 210 may be in the form of, but are not limited to, decorative features, indentations, markings, and other types of indicators.

FIG. 3 depicts exploded view 300 of handle 110 according to an embodiment of the present disclosure. Inner handle 112 and extension 114 may be arranged atop one or more magnets 150. Handle 110 may provide indicator 210A (FIG. 2) that may be provided to align with another indicator 210B (FIGS. 2 and 5) about rod 162 (FIGS. 1-2 and 4-5). It should be appreciated that indicators 210A, 210B may provide decoration or aesthetic features about handle 110 and/or rod 162. Inner handle 112 may provide extension 114 that may be attached to opposing magnet 154. Opposing magnet 154 may be attracted to one or more magnets 150 (FIGS. 1, 3, and 5) that may be arranged inside one or more dosing containers 120 (FIGS. 1-2 and 4-5).

FIG. 4 depicts the assembly 400 of handle 110 and a dosing container 120 in preparation for use according to an embodiment of the present disclosure. In this depiction, rod 162 is partially engaged with extension 114. Assembly 400 may be portable and may provide a size that may provide ease of using, carrying, and displaying each component on display 170 (FIGS. 1-2). Extension 114 provides an outer surface that may have a substantially uniform cross section that is at least partially square, beveled, or other non-cylindrical shape and slides into a correspondingly shaped inner surface of aperture 190 (FIG. 1). It should be appreciated that the outer surface of extension 114 and inner surface of aperture 190 may be both shaped to engage with each other and provide rotational stability when at least partially engaged. Extension 114 may have opposing magnet 154 fixably attached at one end. The one or more metal plates or discs 152 may be attracted to opposing magnet 154. As handle 110 is assembled to the dosing container 120, extension 114 slides into aperture 190 and opposing magnet 154 is attracted to and makes contact with metal disc 152 to secure dosing container 120 to handle 110.

FIG. 5 depicts an exploded view of disassembly 500 of one or more dosing containers 120, applicator 130, and rod 162 according to an embodiment of the present disclosure. Indicator 210A (FIG. 2) that may be provided to align with another indicator 210B about rod 162. Indicators 210A, 210B may provide decoration or aesthetic features about handle 110 and/or rod 162. Opposing magnet 154 may be attracted to one or more magnets 150 that may be arranged inside one or more dosing containers 120. Wiper 160 may be arranged and secured inside dosing container 120 using a snap-fit connection.

One or more dosing containers 120 and one or more applicators 130 may be interchangeable and replaceable. One or more dosing containers 120 may be made of materials including, but not limited to, polypropylene (PP), high-density polyethylene (HDPE), or a mixture of HDE and LDPE. It should be appreciated that one or more dosing containers 120 may be made by injection molding, blow molding, or using another manufacturing process. One or more dosing containers 120 may be made of other materials without departing from the present disclosure. It should be appreciated that one or more dosing containers 120 may house approximately 2.5 milliliters of cosmetic product. It should also be appreciated that one or more dosing containers 120 may house greater or less than approximately 2.5 milliliters of cosmetic product without departing from the present disclosure. It should further be appreciated that one or more dosing containers 120 may provide cosmetic product that may supply a user with approximately two weeks or 14 days of use. It should be appreciated that one or more cosmetic containers may supply greater or less than approximately two weeks or 14 days of cosmetic product. One or more dosing containers 120 may be replaceable, reusable, refillable, and/or recyclable. It should be appreciated that one or more applicators 130 may be in the form of different types of brushes including, but not limited to, fiber and molded brushes. It should also be appreciated that one or more applicators 130 may be in the form of eye, lip, skin, hair, cosmetic, and/or medical applicators.

Embodiments of the present disclosure may provide a kit that may provide handle 110 (FIGS. 1-4), one or more dosing containers 120 (FIGS. 1-2 and 4-5), one or more applicators 130 (FIGS. 1 and 4-5), and display 170 (FIGS. 1-2). Cosmetic dosing system 100, 200 (FIGS. 1-2) may keep the contents or cosmetic product housed by one or more dosing containers 120 fresh, sterile, and reduce the likelihood the formation of bacteria. It should be appreciated that the contents of one or more dosing containers 120 may not dry out, become brittle, or clump. It should be appreciated that a cosmetic dosing system may be in the form of a thermoformed tray that may include handle 110 and one or more dosing containers 120 without departing from the present disclosure. It should also be appreciated that a cosmetic dosing system may be housed in a carton box and/or plastic enclosure.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "approximately 40 mm."

It may be advantageous to set forth definitions of certain words and phrases used in this patent document. The terms "include" and "comprise," as well as derivatives thereof, mean inclusion without limitation. The term "or" is inclusive, meaning and/or. The phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A cosmetic dosing system, comprising:

one or more dosing containers arranged on a display, wherein the dosing containers each have a first end with an aperture having a non-cylindrical cross section and a metal plate fixably attached at the first end; and a handle having a first end configured to slide into the apertures and an opposing magnet attracted to the metal plates, wherein the handle is attached to and removable from the display.

2. The cosmetic dosing system of claim 1, wherein the one or more dosing containers interchangeably attach to the handle.

3. The cosmetic dosing system of claim 1, wherein the one or more dosing containers house approximately 2.5 milliliters of cosmetic product.

4. The cosmetic dosing system of claim 1, wherein the one or more dosing containers supply a user with approximately two weeks or 14 days of cosmetic product.

5. A cosmetic dosing kit, comprising:

one or more dosing containers including one or more metal plates, wherein the dosing containers each have a first end with an aperture having a non-cylindrical cross section and a metal plate fixably attached at the first end;

one or more applicators housed inside the one or more dosing containers;

a handle having an opposing magnet attracted to the one or more metal plates and a first end configured to slide into the apertures; and a display configured to house the one or more dosing containers and the handle.

6. The cosmetic dosing kit of claim 5, wherein the one or more dosing containers interchangeably attach to the handle.

7. The cosmetic dosing kit of claim 5, wherein the one or more dosing containers house approximately 2.5 milliliters of cosmetic product.

8. The cosmetic dosing kit of claim 5, wherein the one or more dosing containers supply a user with approximately two weeks or 14 days of cosmetic product.

* * * * *